US006418697B1

(12) United States Patent
Da Molin

(10) Patent No.: US 6,418,697 B1
(45) Date of Patent: Jul. 16, 2002

(54) PANEL FOR RAISED FLOORS

(75) Inventor: Ferdinando Da Molin, Piove Di Sacco (IT)

(73) Assignee: Joint Venture Partnership Holding S.A. (LU)

( * ) Notice: Subject to any disclaimer, the term of this patent is extended or adjusted under 35 U.S.C. 154(b) by 0 days.

(21) Appl. No.: 09/538,197

(22) Filed: Mar. 30, 2000

Related U.S. Application Data

(63) Continuation of application No. PCT/EP98/06235, filed on Oct. 1, 1998.

(30) Foreign Application Priority Data

Oct. 1, 1997 (IT) ..... PD97U0065

(51) Int. Cl.[7] ..... E04F 15/24; E04C 2/26; E04C 2/08

(52) U.S. Cl. ..... 52/792.11; 52/792.1; 52/795.1; 52/263

(58) Field of Search ..... 52/792.1, 792.11, 52/795.1, 480, 126.5, 126.6, 263

(56) References Cited

U.S. PATENT DOCUMENTS 445,262 A * 1/1891 Kinnear ..... 52/792.11 X
648,632 A * 5/1900 Parker ..... 52/792.11 X
1,930,345 A * 10/1933 Lewis ..... 52/792.1
3,540,116 A * 11/1970 Drahos et al. ..... 52/792.11 X
3,924,370 A * 12/1975 Cauceglia et al. ..... 52/126.6
4,520,057 A * 5/1985 Fujii et al. ..... 428/68
4,944,130 A * 7/1990 Pallhorn ..... 52/792.1
5,046,291 A * 9/1991 Narayan ..... 52/126.6
5,115,621 A * 5/1992 Kobayashi ..... 52/792.11

FOREIGN PATENT DOCUMENTS

GB 351888 * 7/1931 ..... 52/792.1
GB 842939 * 7/1960 ..... 52/792.11
GB A-2 130 615 6/1984
GB A-2 187 219 9/1987

* cited by examiner

*Primary Examiner*—Laura A. Callo
(74) *Attorney, Agent, or Firm*—Greer, Burns & Crain, Ltd.

(57) ABSTRACT

A panel for raised floors, which comprises: a box-like element made of metallic material, which forms a bottom and side walls with first edges which are folded outwards and is meant to contain a body made of filler material; and a covering element. The covering element also is made of metallic material, is flat, is larger than the dimensions of the box-like element and has second edges which are folded a first time around the first edges of the box-like element. The first and second edges of the box-like element and, respectively, of the covering element are folded together a second time along the side walls, so as to be arranged laterally thereto in order to reduce the dimensions of the panel and increase its loading strength along its sides.

4 Claims, 2 Drawing Sheets

PANEL FOR RAISED FLOORS

CROSS-REFERENCE TO RELATED APPLICATIONS

This application is a continuation of application number PCT/EP98/06235 filed on Oct. 1, 1998.

BACKGROUND OF THE INVENTION

The present invention relates to a panel for raised floors. Conventional raised floors are constituted by a metal frame formed by pedestals which rest on a supporting surface and on top whereof modular panels of standard sizes are placed and conveniently arranged side by side.

In this manner, a gap is formed between the lower surface of the panels and the original floor and it is possible to arrange in the gap, for example, the wires of the electrical system, telephone connections, air conditioning piping, computer power supply connections, and other items.

It is in fact advantageous to install raised floors mainly because of the fact that in case of malfunction or maintenance the prefabricated panels can be easily removed to repair the system and can then be reinstalled in the metal frame.

The panels generally have a covering which is for example made of wood, carpeting, ceramic or stone, so as to make the raised floor fully similar to ordinary floors.

Most panels for raised floors are currently constituted by the assembly of a flat body, made of filler material, with metallic reinforcement plates the thickness whereof is a function of the intended loading strength.

The filler material consists for example of chipwood combined with thermosetting resins, or of calcium silicate with inert fibers, or of calcium sulfate with inert fibers.

The plates are preferably made of galvanized steel so as to increase the load-bearing ability of the floor, particularly when the flexural stresses produced by pedestrian traffic, the passage of trolleys or the weight of pieces of furniture or other static loads increase the load that affects the panels.

During their operating life, the panels usually have a severe drawback due to the fact that they slowly warp and form an upward-facing concavity.

This produces a discontinuity between contiguous panels which causes the edges to be raised with respect to the central parts, which have sagged.

Commercially available panels are currently constituted by an internal body which has a quadrangular structure the lateral walls whereof are slightly inclined, so that the only region of contact with the adjacent panels is constituted by the upper profile.

A type of panel constituted by an internal body with conveniently inclined lateral walls and provided, in a downward region, with a galvanized steel tray and, in an upward region, with a box-like cover is currently widely used.

This kind of panel for raised floors is assembled by bending the edges of the box-like cover so as to follow the side walls of the internal body and so as to close along the outer perimetric profile of the lower tray by means of interlocking engagements provided by means of first studs formed along the entire perimetric profile.

However, in order to be able to correctly arrange the panels at the heads of the supporting pedestals it is necessary to provide second centering studs on said folded edges of the cover. These studs can be produced for example by means of a press, in a per se known manner.

Unfortunately, the second centering studs are obtained by means of deformations which inevitably twist the panel, with consequent panel warping problems.

Another type of panel is currently used increasingly which is constituted by a box-like element made of galvanized steel which forms a bottom and side walls which are conveniently inclined and have edges which fold outwards.

The body made of filler material is arranged inside the box-like element and is then covered by a cover.

The edges of the cover are folded around the edges of the box-like element, so as to assemble the panel.

In this case, however, the useful space for resting the panel on the head of the pedestal is reduced considerably due to the bulk of the two edges folded together.

GB-A-2,187,219 discloses a panel for raised floors.

GB-A-2,130,615 discloses a floor panel, comprising a core enclosed in an outer shell which has a top plate slightly larger than the base tray of the shell, the top plate having side walls that fit over and around the side walls of the base tray.

SUMMARY OF THE INVENTION

The aim of the present invention is to provide a panel for raised floors having a structure which eliminates the above drawbacks.

Within the scope of the above aim, an object of the present invention is to provide a panel for raised floors which remains substantially unchanged over time without undergoing deformation and withstands even high concentrated loads.

Another object of the invention is to provide a panel for forming raised floors which is capable of withstanding a much greater load applied to the center of its side than conventional panels.

Another object of the invention is to provide a panel for raised floors which solves the problem of creaking produced by interference between the edges of contiguous panels.

Another object of the invention is to provide a panel for raised floors which can be provided with a simple structure by means of conventional processes.

This aim, these objects and others which will become apparent hereinafter are achieved by a panel for raised floors, as described and claimed herein.

BRIEF DESCRIPTION OF THE DRAWINGS

Further characteristics and advantages of the present invention will become apparent from the detailed description of an embodiment thereof, illustrated only by way of non-limitative example in the accompanying drawings wherein.

DESCRIPTION OF THE PREFERRED EMBODIMENTS

Figure 1:
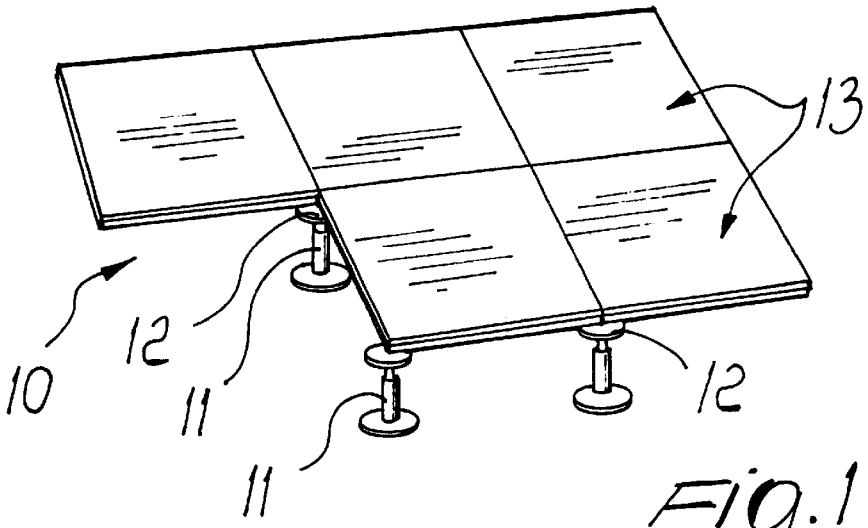
FIG. 1 is a perspective view of a raised floor.
Figure 2:
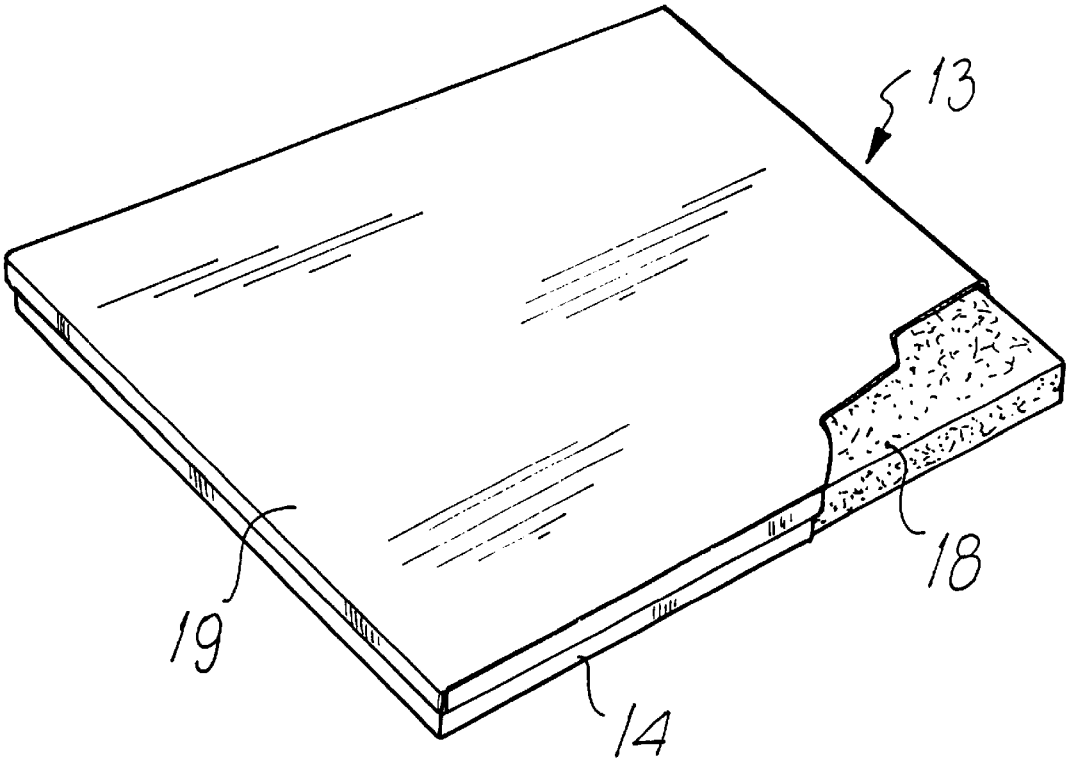
FIG. 2 is a partially sectional perspective view of a panel according to the invention.
Figure 3:
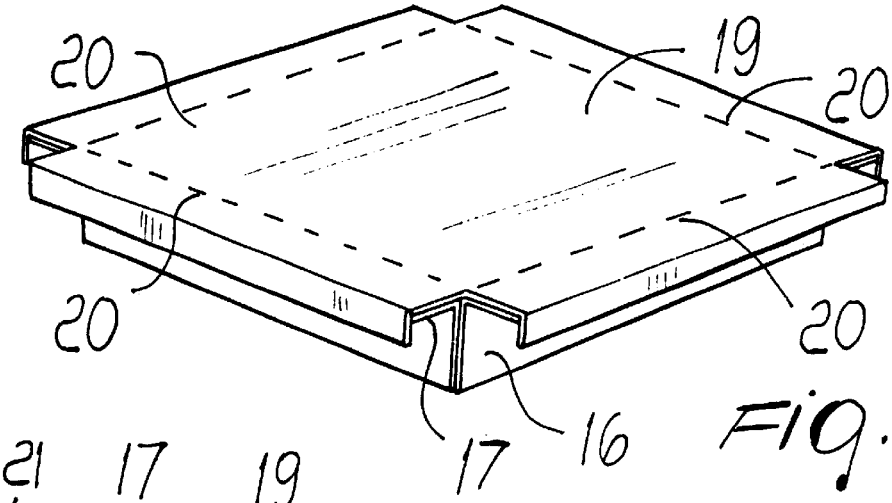
FIG. 3 is a perspective view of the panel of FIG. 2 in a first step of assembly.
Figure 5:
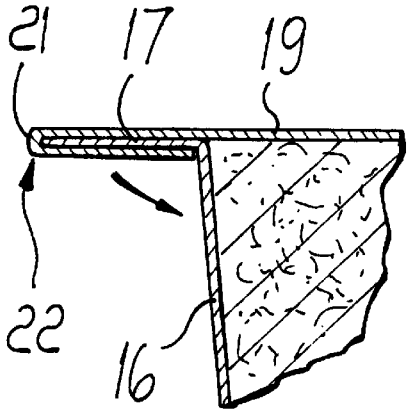
FIG. 5 is a sectional view, taken along a transverse plane, of a detail of the panel according to the invention in a second step of assembly.
Figure 4:
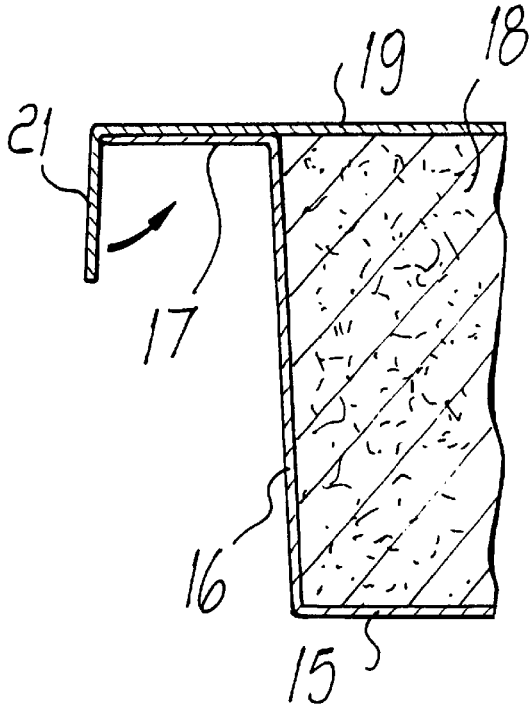
FIG. 4 is a sectional view, taken along a transverse plane, of a detail of the panel shown in FIG. 3.
Figure 6:
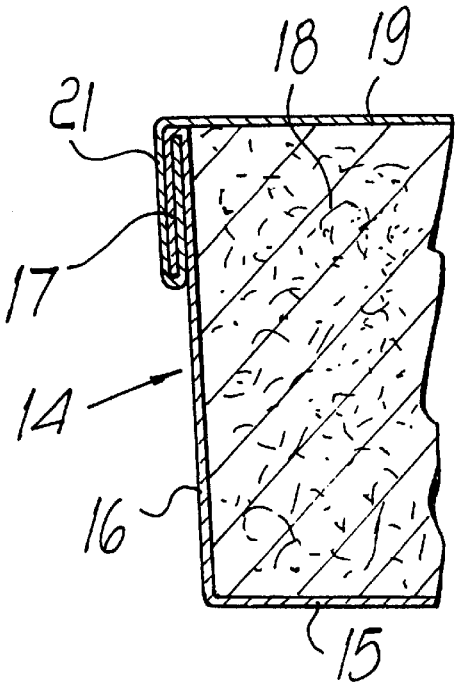
FIG. 6 is a sectional view, taken along a transverse plane, of a detail of the panel shown in FIG. 2.

With reference to the above figures, a raised floor is generally designated by the reference numeral 10 and is constituted by a plurality of pedestals 11 which rest on a flat surface; each pedestal forms a head 12 on which panels 13 according to the invention rest.

In this embodiment, each panel 13 is constituted by the assembly of a box-like element 14 which is made of galvanized steel and forms a bottom 15 and side walls 16, each of which being conveniently inclined and provided with a first edge 17 which is folded outwards.

The inside of the box-like element 14 is spread with a binary glue of the type easily commercially available, for example of the neoprene or vinyl type, for fixing a body 18 made of filler material which is to be accommodated within the box-like element 14.

The body 18 has a quadrangular shape which is substantially complementary to said box-like element 14.

Finally, in an upward region there is a covering element 19 which is made of galvanized steel and has a flat structure.

Sides 20 are formed in the covering element 19 and substantially coincide with the profile of the body 18; a second edge 21 protrudes from each one of the sides 20, is as long as the side 20, and is wider than the corresponding first edge 17 of the box-like element 14, around which it is folded a first time so as to form a ridge 22.

In this manner, the structure of the covering element 19 is quadrangular and substantially without corners.

The assembly of the box-like element 14, inside which the body 18 is arranged, with the covering element 19 to form the panel 13 is achieved by folding each one of the ridges 22 a second time, arranging them parallel to the side walls 16 and laterally adjacent thereto.

In this manner, the first and second edges 17 and 21 of the box-like element 14 and of the covering element 19 respectively, which are folded together along the sides 16, act edgeways with respect to the loads applied along each one of the sides 20 and thus increase the loading strength of the panel 13.

At the same time, the arrangement assumed by the first and second edges 17 and 21 provides retention of the panel 13 and minimizes bulk.

With this solution, each panel 13 in fact rests stably on the corresponding head portion 12 of a pedestal 11 assigned thereto, by virtue of the extremely compact dimensions of the two edges 17 and 21 which are folded along the walls 16.

It has thus been observed that the panel according to the present invention amply achieves the intended aim all the objects.

In particular, an important advantage is achieved with the present invention in that a panel for raised floors has been provided which solves the problem of creaking due to interference between the edges of contiguous panels, since the contact region is limited exclusively to the upper profile.

Another advantage is ensured in that a panel has been provided which has a simple structure and whose assembly is effective and practical to perform.

It should be noted that the first and second edges are folded by cold-working them and therefore such folding does not affect the mechanical features of the panel.

The materials used, so long as they are compatible with the contingent use, as well as the dimensions, may be any according to the requirements.

What is claimed is:

1. A panel for raised floors, comprising:

a box-like element made of metallic material, which forms a bottom and side walls with first edges which are folded outwards and is meant to contain a body made of filler material; and a covering element, also made of metallic material, which is flat, is larger than the dimensions of said box-like element and has second edges which are folded a first time around said first edges of said box-like element; said first and second edges of said box-like element and, respectively, of said covering element being folded together a second time along the side walls, and being arranged laterally thereto in order to reduce the dimensions of said panel and increase its loading strength along its sides, wherein the side walls of said box-like element are inclined so as to form, at the covering element, edges for contact with contiguous panels, said first and second edges of said box-like element and of said covering element being also arranged inclined with respect to both the bottom of said box-like element and said covering element, laterally adjacent and parallel to the inclined walls of said box-like element.

2. A The panel according to claim 1, wherein said box-like element and said covering element are made of galvanized steel.

3. The panel according to claim 1, wherein said box-like element is internally spread with a binary glue for fixing said body.

4. The panel according to claim 1, wherein said first and second edges are folded by means of cold-working.

* * * * *